US006394901B1

(12) United States Patent
Marta

(10) Patent No.: US 6,394,901 B1
(45) Date of Patent: May 28, 2002

(54) GAMING DEVICE

(76) Inventor: John A. Marta, 4700 Weldin Rd., Wilmington, DE (US) 19803

( * ) Notice: Subject to any disclaimer, the term of this patent is extended or adjusted under 35 U.S.C. 154(b) by 0 days.

(21) Appl. No.: 09/603,098

(22) Filed: Jun. 26, 2000

(51) Int. Cl.[7] ..... A63F 9/24
(52) U.S. Cl. ..... 463/20; 273/146
(58) Field of Search ..... 463/16, 17, 20, 463/21, 22, 30; 273/146, 274

(56) References Cited

U.S. PATENT DOCUMENTS 4,339,798 A * 7/1982 Hedges et al. ..... 364/412
4,506,890 A * 3/1985 Murry ..... 273/138 A
5,732,948 A * 3/1998 Yoseloff ..... 273/274
5,803,451 A * 9/1998 Kelly et al. ..... 273/118 R
5,829,749 A * 11/1998 Hobert ..... 273/274
5,964,463 A * 10/1999 Moore, Jr. ..... 273/274
6,173,955 B1 * 1/2001 Perrie et al. ..... 273/146
6,213,876 B1 * 4/2001 Moore, Jr. ..... 463/22

* cited by examiner

*Primary Examiner*—Joe H. Cheng
*Assistant Examiner*—Kim T. Nguyen
(74) *Attorney, Agent, or Firm*—E. Alan Uebler, PA

(57) ABSTRACT

A gaming device configured as a slot machine for play of the dice game of craps is provided. The device provides all of the nuances associated with the casino play of the craps game while, simultaneously, eliminating all biases historically associated with the play of this game.

9 Claims, 6 Drawing Sheets

GAMING DEVICE

BACKGROUND OF THE INVENTION

The invention relates, generally, to the play of the dice game known as "craps". More specifically, the invention provides a device for the play of craps housed in and played substantially as a conventional slot machine.

In the conventional game of craps, two standard, matched dice are used. The players start the game by rolling for "high dice" and the player who rolls the highest total on the two dice plays the game first, becoming the "shooter" (or the "roller" or "caster"). Variations on the casino play of the game are discussed more fully below.

Initially, the shooter may bet any desired amount. He announces his bet and places it on the playing surface, generally in the center of the surface being played upon. The shooter's bet may be accepted, or "faded", in whole or in part, by any other player. Each player, in turn to the caster's left, may take (fade) as much of the shooter's bet as he wishes, with precedence accorded to a player willing to fade the entire bet.

When the bet is faded, the shooter rolls the dice from his bare hand, no cup ever being used, shaking them before rolling, generally producing clicking to assure the other players that he is not casting them in a preset position or mode.

Under the rules of the game, if the faces of the two dice add up to 7 or 11 on the first roll, that is termed a "natural", and the shooter wins immediately. He collects the bets and keeps the dice, and the betting and fading proceed to the next roll of dice.

However, if the total on the dice at the first cast is 2, 3 or 12, that outcome event is termed "craps" or "crapping out", and the shooter loses, but he keeps the dice.

If the total shown on the first roll is any other of the possible numbers—4, 5, 6, 8, 9 or 10—the number shown on the dice becomes the shooter's "point". At this stage of play, the shooter has neither won nor lost. He continues to roll until either: (a) the dice repeat the same number, that is, he makes his point, in which case he wins, or (b) the dice rolled total 7, in which case he loses and the dice pass to the next player on his left, who becomes the new shooter.

A winning roll, whether from a natural or from making a point, is called a "pass". After each pass, the shooter may change his bet.

In usual play, side bets are permitted. That is, having rolled a point, the shooter bets additionally on whether or not he will make his point, and other players may bet on the same question among themselves. To win consistently, a player must be cognizant of the odds available at each throw of the dice.

In most games, there is continual action in betting. If the shooter rolls a point, he may additionally bet on the series of rolls beginning with his next roll, which are called "come" or "don't come" bets. He may bet that he is "right" or "wrong", meaning that he will shoot a winning number or crap out, respectively, in the next roll. These designations may have different meanings in different localities, so the player should ascertain the meaning of these terms at the location of play.

In commercial casinos, crap shooting is a favorite game. The players group around a large, felt-covered table. One or more dealers control the game, pay and collect bets, etc. Usually there are two, including a stick man who handles the dice and a cashier. Players do not bet among themselves, but against the house, at odds determined by the house. The standard layout of a craps table may be found in any comprehensive book on gaming and/or on the internet gaming sites which have recently proliferated.

The players take turns casting the dice as in any crap game. Any player may bet upon himself as the shooter, or upon whoever is shooting, the latter termed a "line" or "pass line" bet. The house covers all such bets, up to a determined and certain limit per player.

When a player wishes to fade, a term not normally used in casino games, it is called betting "wrong". The result of this bet is altered to restore to the house the advantage, whereby, if the shooter craps out by throwing a 2 or 3 on the first roll, or he throws a point and then fails to make that point, the house pays. If, however, the shooter's first roll is 12 (double "6's"), the bettor does not win, but the bet is called off entirely (a tie) and he keeps his money. Different houses may bar different numbers, i.e., 1-1, and again local rules should be determined.

Once a player has selected a bet amount, he places that bet on the craps table in the designated area. Once all bets are placed, the dice are rolled.

The most popular bet at the table is the "pass line" bet, also called the "front line". A wager on the pass line wins if the first roll of the dice, called the "come out" roll, when no point is established, is either a 7 or 11, i.e., a "natural". The player loses on the come out roll with a pass line bet if 2, 3 or 12 is rolled.

If any other number is rolled on the come out roll, e.g., 4, 5, 6, 8, 9 or 10, that number becomes the "point". Once the point has been established, the player (or shooter) in successive rolls must repeat the point before a 7 is rolled. If the shooter rolls a 7 before the point is repeated, the pass line bet loses. A winning bet is paid even money.

A "don't pass" bet, also called a "back line" bet, is the opposite of the pass line bet. It can only be placed on a come out roll with no point established. This bet wins if the shooter rolls either a 2 or 3 on the come out roll and loses immediately if a 7 or 11 is rolled on the come out roll. When the point has been established, this bet wins if the shooter rolls a 7 before the point is repeated.

The "come" or ("right") bet is an extension of the pass line bet and may be wagered after the point has been established on the come out roll. The rules for this bet are the same as the pass line bet. The come bet wins if a 7 or 11 is next rolled and loses if a 2, 3 or 12 is rolled. Any other number becomes the come point and must be repeated before a 7 rolls in order to win even money. If the shooter rolls a 4, 5, 6, 8, 9 or 10 after a come bet has been placed, the dealer will move the come bet from the come area to the corresponding box for that particular number. Just as with the pass line bet, this wager may not be reduced or removed until play is completed. A winning wager is paid even money.

The "don't come" (or "wrong") bet is the opposite of the come bet. It may be wagered any time after the point has been established on the come out roll. A first roll of 7 or 11 loses, 2 or 3 wins, and 12 is a standoff. If a 4, 5, 6, 8, 9 or 10 is rolled after a don't come bet has been placed, the dealer will move the wager from the don't come area to the corresponding box for that particular number. The player wins even money if 7 is rolled before the point is repeated.

Whenever a shooter rolls doubles and the outcome is a 4, 6, 8 or 10, the shooter is said to have hit the number the "hard way", that is, by rolling doubles. If any of these same numbers are rolled and the outcome is not doubles, the shooter is said to have hit the number the "easy way". A hard way bet wins when the shooter rolls a number the hard way. A hard way bet loses if the shooter rolls a number the easy way or if the shooter rolls a 7. Usually hard way 4 and 10 pay 7 to 1 and hard way 6 and 8 pay 9 to 1.

A "field" bet is a wager that the next roll will be a 2, 3, 4, 9, 10, 11 or 12. The 2 and the 12 pay double in most houses.

The present invention provides, in slot-machine format, all of the thrills associated with the play of the game of craps and is similar, in every respect, to the play of the game at a casino craps table. Eliminated in the device of the invention are all biases in favor of the house such as those arising from biased dice or an overly skilled croupier. In fact, in the play of the game according to the invention, human intervention is eliminated completely.

Other casino games, and even pari-mutuel horse racing, have been adapted so as to be played in slot-machine-like devices. For example, poker, keno, lotto and bingo all have slot-machine counterparts to be found in the patent literature (see, e.g., U.S. Pat. Nos. 5,935,002 and 5,800,269). No known reference, however, discloses or suggests play of the game of craps, in all its significant detail, in the configuration of a slot machine.

SUMMARY OF THE INVENTION

A slot machine gaming apparatus having means for simulating play of the dice game of craps is provided. In a preferred embodiment, the apparatus is contained in a single free-standing housing and comprises a pair of dice, or simulation thereof, and has means for throwing or "shooting" the dice into a pit area. The apparatus includes means for sequentially placing a desired wager upon the outcome of an initial throw (the "come out roll") and selected subsequent throws of the dice, as well as means for receiving wagers upon the initial and selected subsequent throws of the dice. Wagers on the initial throw may be either "pass line" or "don't pass" wagers, and wagers on subsequent throws may be either "right" or "wrong" wagers, or any of the various wagers available in the game, discussed further hereinbelow. Means for initiating play, that is to initially actuate the means for throwing the dice, are provided, as well as means for determining the total shown on the dice after each throw, and means for throwing the dice subsequent to the initial, actuating throw, and including means for tallying the cumulative winning or positive outcomes of each initial and subsequent throws and wagers according to a predetermined schedule.

The apparatus includes means for displaying and paying out to the player the total winnings, if any, accrued from the initial throw of the dice and through subsequent play of the game, all according to a predetermined schedule of odds.

The means for initiating play may be a conventional slot machine lever or handle, or a push button. The means for throwing the dice preferably includes a simulated human hand from which the dice are ejected into the pit area by mechanical means. Alternatively, the means for throwing the dice may be simulated by means of a video display.

In this apparatus, the means for tallying the cumulative winning outcomes of the initial and subsequent throws and wagers preferably includes means for stopping play of the apparatus at the occurrence of the first to occur of the following events:

on an initial "pass line" wager or on a subsequent "right" wager:

(a) the total shown on the two dice adds up to 7 or 11 on the next cast;

(b) the total shown on the two dice adds up to 2, 3 or 12 on the next cast; and on an initial "don't pass" wager or on a subsequent "wrong" wager:

(c) the total shown on the two dice adds up to 2 or 3 on the next cast;

(d) the total shown on the two dice adds up to 7 or 11 on the next cast; or (e) the total shown on the next cast adds up to any one of 4, 5, 6, 8, 9 or 10 and the total on a subsequent cast:

(i) is repeated, or (ii) adds up to 7.

Preferably, each die of the dice pair has electroconductive spots thereon and the floor of the pit area has electronic detecting sensors embedded therein. These sensors detect, after each throw of the dice and upon the dice coming to rest upon the floor, the total number of spots showing on the top faces of the dice.

The apparatus may also include means for placing a field wager, that is, that the initial or subsequent roll is a 2, 3, 4, 9, 10 11 or 12, and wherein a total of 2 or 12 pays double. It may also include means for placing hardway wagers, that is by rolling double 2's, 3's, 4's or 5's. Still further, means for placing one roll bets, that is by rolling a particular number on the next roll of the dice, may be included.

DETAILED DESCRIPTION OF THE INVENTION AND PREFERRED EMBODIMENTS WITH REFERENCE TO THE DRAWINGS

A gaming device configured as a slot machine for play of the dice game of craps is provided. The device provides all of the nuances associated with the casino play of the craps game while, simultaneously, eliminating all biases historically associated with the play of this game.

Figure 1:
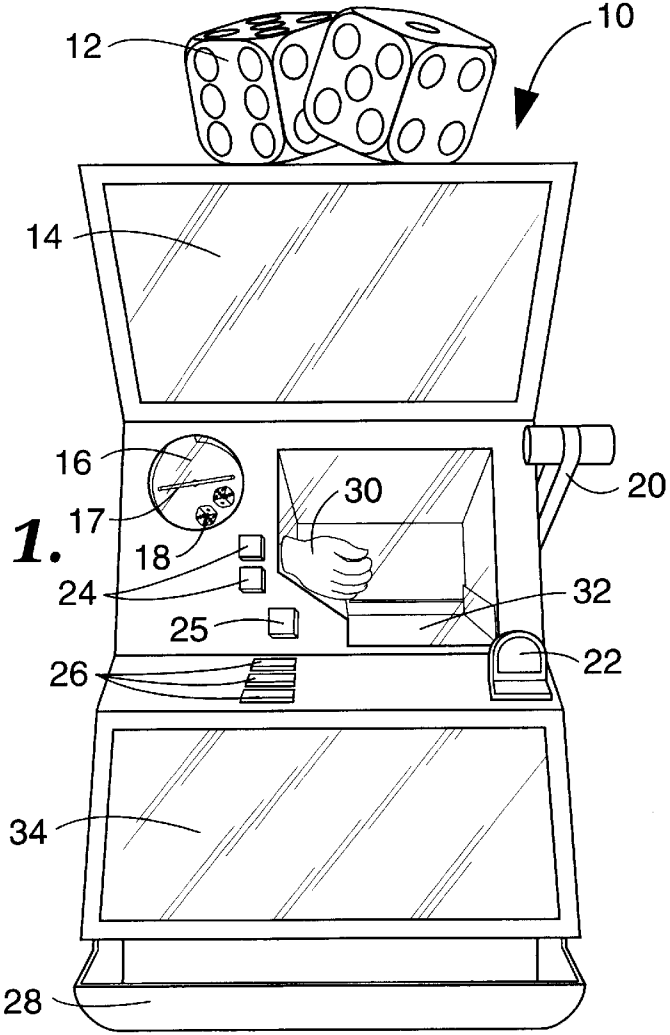
FIG. 1 is a front elevational perspective view of the device according to the invention.

A detailed description of the invention and preferred embodiments is best provided with reference to the accompanying drawings wherein FIG. 1 depicts a front elevation of one embodiment of the gaming device according to the invention. Therein the apparatus 10, housed within a generally conventional slot machine configuration, includes displays 14 and 34 and actuating handle 20, coin-receiving slot 22 for receiving wagers, and payout tray 28 wherein the player receives his winnings, if any. Push button means 24, 25 and 26 are used to optionally activate variations in the play of the game desired by the player including the placing of "right" or "wrong" bets, described more fully below.

In the configuration shown in FIG. 1, a pair of dice 18 are contained within the holding chamber 16 prior to play, which has a glass view panel to enable the player to see the dice. A mechanical agitator 17 serves to keep the dice tumbling and in full view of the player prior to play.

Within the "pit" area 32 shown, also covered by and viewed through a glass pane, is a mechanically actuated simulated hand 30, which physically "throws" the dice 18 upon actuation of the lever handle 20. In actuality, the tumbling dice 18, on pull of lever 20, are conveying to and through the hand 30 and into the pit area 32, all providing the appearance of having been thrown there.

Displays 14 and 34 may include various schedules useful in the play of the game of craps such as the odds paid out on various winning combinations shown on the dice, instruction in the play of the game, and other possibly useful or desirable displays. While the mechanical hand 30 is depicted for playing the game according to the invention, and is preferred, video means could also be adapted to this use and would be displayed, e.g., in area 14.

Some slot machines have an electronic push button for initiating play instead of the conventional handle. In the configuration shown, one of the buttons, 24, 25, or 26, i.e. 25, can alternatively be used for this purpose and handle 20 is not then needed.

Display dice 12 mounted atop the gaming device may be intermittently illuminated from within thereby attracting attention and drawing potential players to the uniqueness of this particular device for the play of the dice game of craps in the non-conventional environment of a slot machine.

Figure 2:
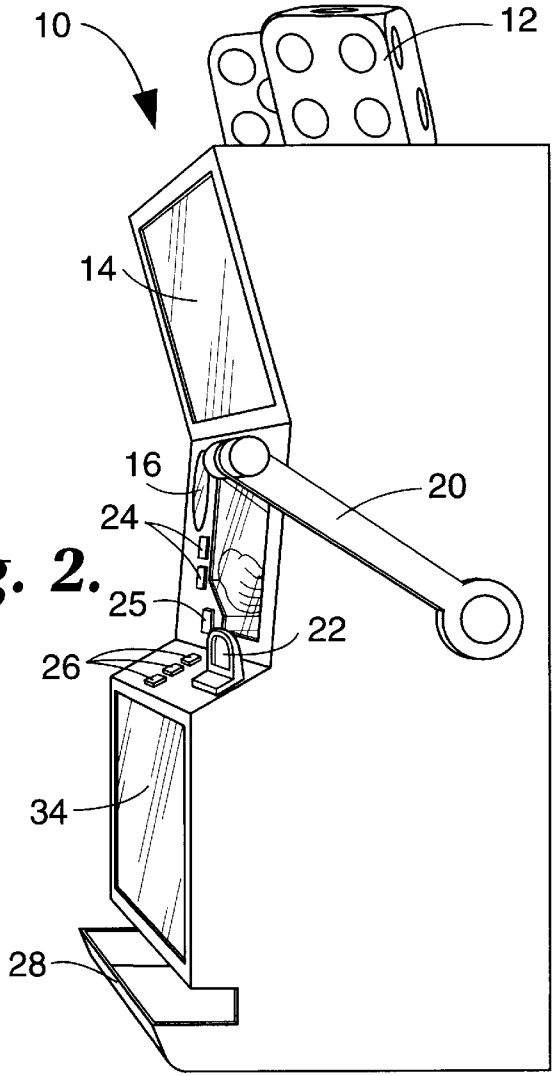
FIG. 2 is a right side elevational perspective view of the device of FIG. 1.

FIG. 2 depicts a side elevation of the apparatus 10, including the displays 14 and 34, handle 20 and payout tray 28. Coin receiver 22 and buttons 24, 25 and 26 may be seen, as is the dice display/holding chamber 16, described in greater detail below.

Figure 3A:
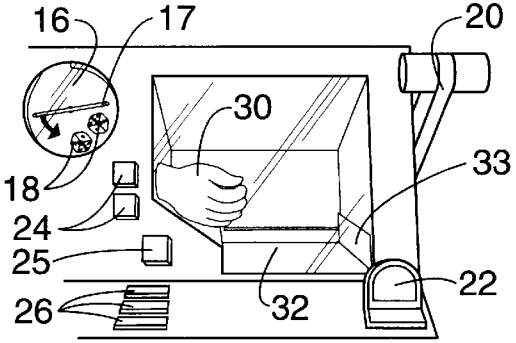
FIGS. 3*a* through 3*f* depict schematically the sequence of events which occur during play of the device disclosed herein, from the dormant machine (FIG. 3*a*), to insertion of a coin (FIG. 3*b*) and pull of the handle and shaking of the dice (FIG. 3*c*), "shooting" the dice (FIG. 3*d*) to display and reading of the total (FIG. 3*e*), followed by return to the dormant position ready to begin another play (FIG. 3*f*).

The sequence of typical events in the play of the game according to the invention is depicted schematically in FIGS. 3*a* through 3*f*. In FIG. 3*a*, the apparatus 10 is shown at rest, awaiting a player. The dice 18 are tumbling slowly, indicated by the arrow, within the tumbling chamber 16 acted upon by the mechanical agitator 17. The shooting hand 30 is shown in its closed, rest position, prior to insertion of a coin into receiver slot 22 and pull of handle 20 to initiate play.

Figure 3B:
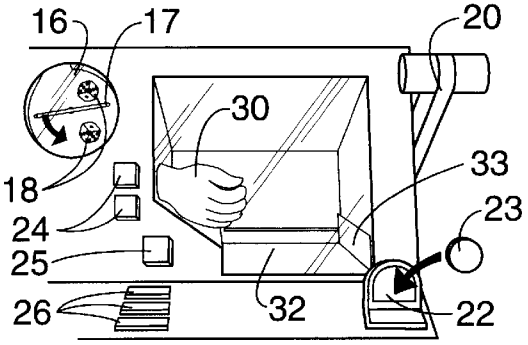

FIG. 3*b* depicts coin 23 being inserted into receiver 22, still prior to play and otherwise as shown in FIG. 3*a*.

Figure 3C:
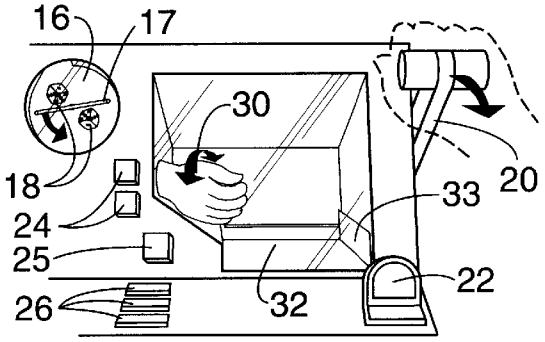
Figure 3D:
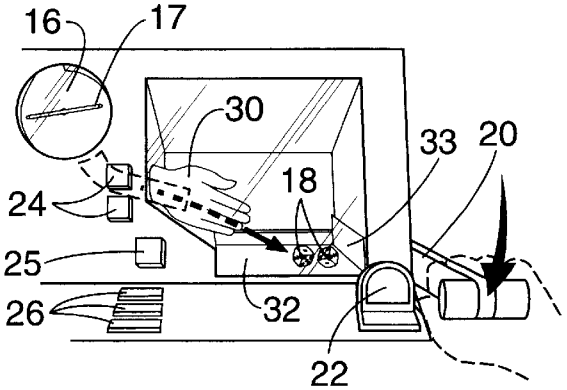
Figure 3E:
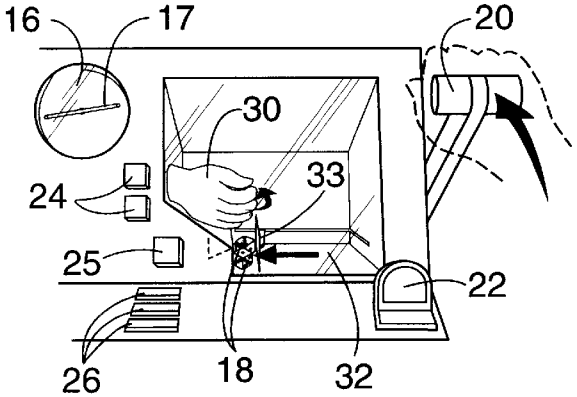

The actual player, depicted by the hand shown in phantom in FIG. 3*c*, pulls the handle 20 thereby, optionally, speeding up the tumbling of the dice 18 followed by conveying the dice to hand 30 which oscillates to simulate shaking the dice prior to shooting, as suggested by the double-headed arrow. The sequence from FIGS. 3*c* through 3*d* happens rapidly, the latter depicting dice 18 being rolled into the pit 32 as the hand 30 opens, all as indicated by the dashed arrow, with the dice coming to a rest position in the pit 32 for readout of the total shown thereon.

The dice total after each throw is read electronically and recorded within the machine and tallied according to preset programming which determines the result of that throw.

Figure 3F:
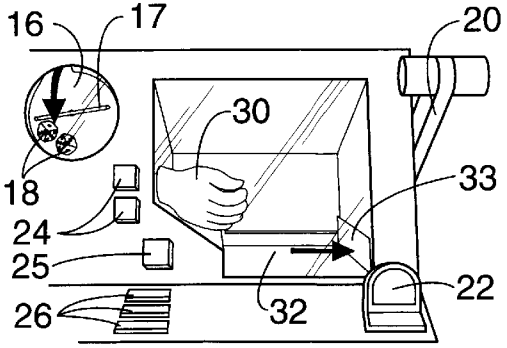

At the end of the roll, the handle 20 returns to its start position and gate 33 sweeps across the pit area 32 and pushes the dice 18 out of the pit and onto a conveyor (not shown) for return to the tumbling chamber 16. Simultaneously the hand 30 again closes, as indicated by the arrow, in preparation for the next play, all shown in FIG. 3*e*. Following this sequence of events and as shown in FIG. 3*f*, the gate mechanism 33 returns to its initial rest position, the dice 18 are again being tumbled within chamber 16, both indicated by the arrows, and the device is ready for the next play.

Figure 4:
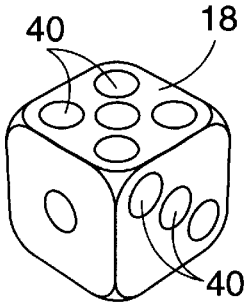
FIG. 4 shows a die used in play of the invention and FIG. 5 shows the possible configurations of die outcomes (total spots), the dots of each die being electroconductive (or magnetic) to enable automatic electronic readout of the total shown on the dice instantaneously upon the dice coming to their rest position after each throw.

FIG. 4 shows a typical die 18 used in the play of the device 10. The spots 40 on each die 18 are rendered electroconductive to enable instantaneous electronic readout of the total shown on the dice after each throw, as described and explained more fully below.

Figure 5:
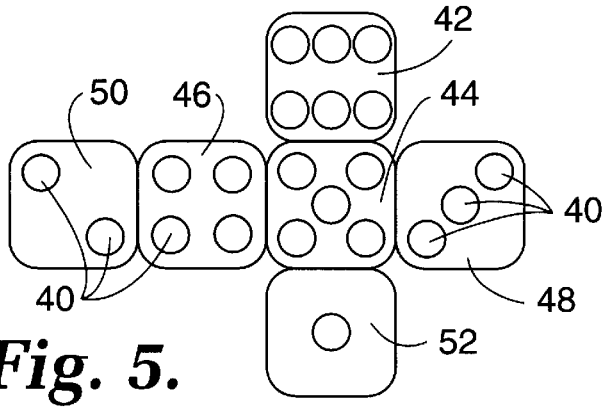
Figure 6:
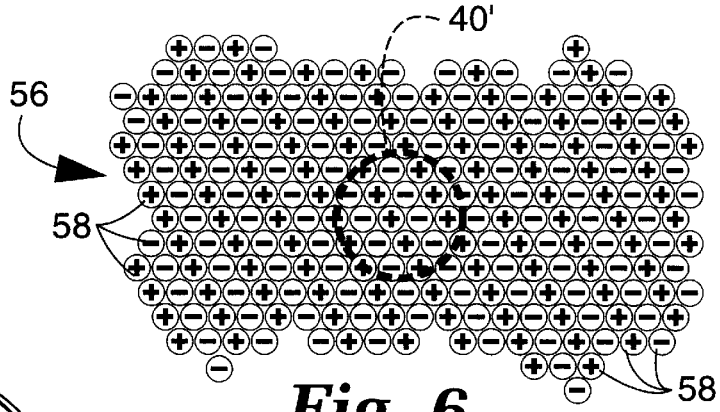
FIG. 6 shows a possible matrix of electronic sensors embedded within the floor of the "pit", which sensors are programmed to read the "footprint" (translated electronically to "dice total" shown) at each throw of the dice during the play of the game.

FIG. 5 is simply a pattern showing the relative configurations of possible rest patterns which each die may assume. When a die comes to a rest position on the floor of pit 32, small electrical sensors embedded within the floor in a printed circuit therein are closed according to the number of conductive spots on the dice which contact the pit floor after a given throw. Because the readout of each die must indicate the number of spots showing on its top face, the totaling and tallying after each throw must be programmed to read that number showing on the opposite face of the die face in contact with the floor 32. That is, if a die falling on the pit floor has its 6-spot face resting on the floor, the read-out total is electronically programmed to display the opposite face total, or the 1-spot. Similarly, the 5-spot face is read as a 2, the 4-spot as a 3, the 3-spot as a 4, the 2-spot as a 5 and the 1-spot as a 6. Each possible pattern is shown in FIG. 5 and an exploded view of a possible sensor pattern 56 to detect these totals is shown in FIG. 6.

The pattern 56 of ± sensors 58 all closely packed in the configuration shown provides one possible means for reading the total shown on the dice 18 following each throw in the play of the craps game. The dashed line 40' shown in FIG. 6 illustrates one spot 40 on a die and its coverage area on the pattern 56 of the pit floor 32. As may be seen, because the spots 40 on the dice are electronically conductive, at rest each die closes a number of the circuits in pattern 56 according to the total number of spots resting on the floor. This total is converted electronically to the dice total showing to the player for tallying purposes, as described above. For example, if each of the tiny sensors shown in FIG. 6 represents a charge of 1/10 volt, then each spot 40 closes approximately 1 volt, i.e. it completes an average of 10 circuits as shown, and the total number of spots on each die in surface contact with the pattern 56 is determined, thereby permitting the distinctions between, say, a "2" and "2" versus a "3" and "1" throw. While this embodiment of a means for die read-out achieves the desired result, it will be clear to one skilled in the art that many other mechanisms are possible for achieving this purpose, and all such mechanisms are considered to be within the scope of the invention.

Figure 7:
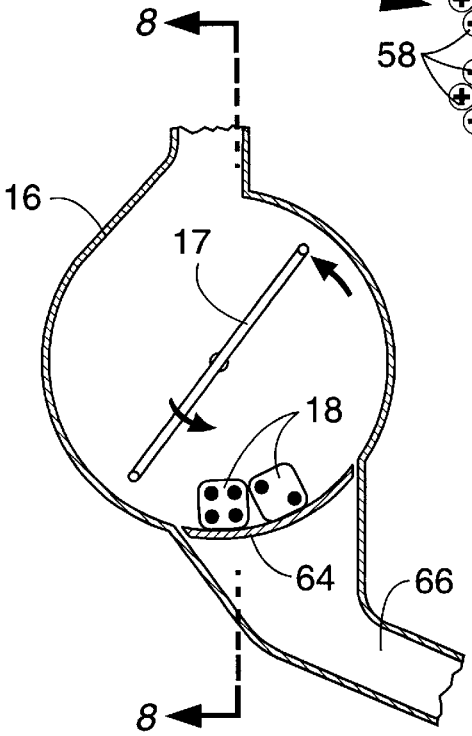
FIG. 7 depicts a tumbling device which enables viewing of the dice by the player before each throw, taken substantially along line 7—7 of FIG. 8 which shows schematically the tumbling chamber which houses the dice prior to each throw.
Figure 8:
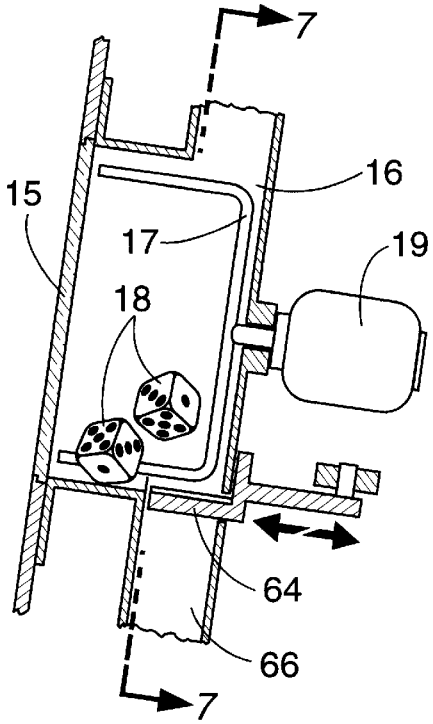

FIGS. 7 and 8 depict a simple tumbling mechanism for agitating the dice during non-playing rest modes of the device according to the invention. In FIG. 7, the dice 18 are agitated by the mechanical vane stirrer 17 rotating as indicated by the arrows within the chamber 16. Upon initiation of play, the gate 64 opens and the die 18 fall into chute 66, to be conveyed to the "hand", described below. After a play, the dice are reconveyed back to chamber 16 through chute 62.

Figure 9:
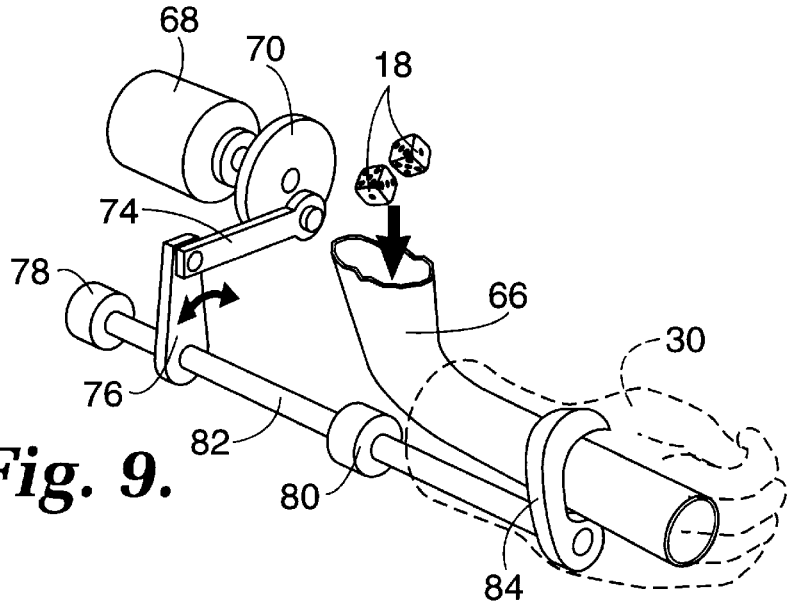
FIG. 9 depicts the mechanical operation of conveying the dice from the holding and tumbling chamber to and through the mechanical hand shown in phantom which "shoots" the dice during play of the game.

FIG. 8 is a cross-section taken substantially along line 8—8 of FIG. 7 showing the agitated dice 18, visible through window 15, stirred by vane 17 within chamber 16, the stirrer powered by motor 19. Upon the start of play, the gate 64 opens as indicated by the arrow, dropping the dice 18 into the chute 66. When the gate 64 opens, the dice fall into chute 66, shown schematically in FIG. 9, the chute 66 leading to the mechanical hand 30, shown in phantom in FIG. 9. The various movements of the hand 30 and its attached arm are illustrated in FIGS. 9 through 11.

In these figures, upon insertion of a coin or coins into the apparatus, drive shaft 80 is caused to oscillate on command (to simulate "shaking" of the dice) by means of motor 68 driving flywheel 70 to which is connected offset pin 72 on which is mounted linkage 74, all of which move bracket 76 in a back-and-forth pattern (indicated by the double-headed arrow) to provide the simulated shaking movement of hand 30. Drive shaft 82 is mounted in bearings 78 and 80 and has gripping bracket 84 affixed at its end thereof as shown.

Figure 10:
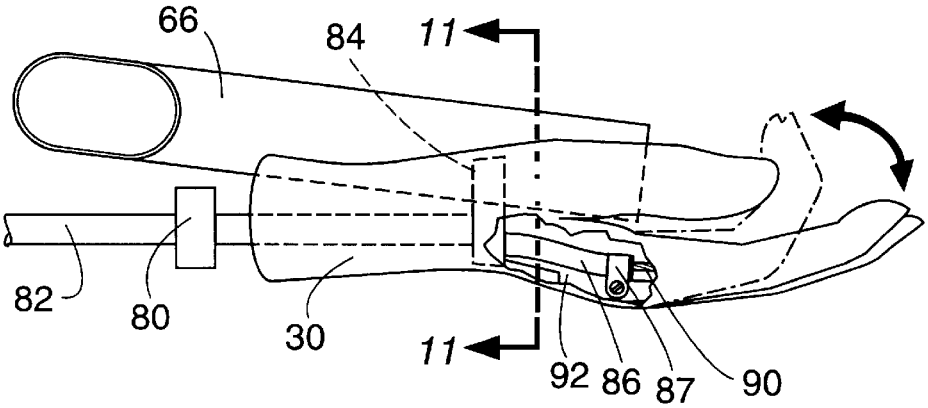
FIG. 10 depicts the mechanical hand in a closed configuration.

In the top view of the hand mechanism shown in FIG. 10, the chute 66 is shown positioned so as to be not visible to the player, being concealed from view by the hand 30. The drive shaft 82 carried in bearing 80 extends to bracket 84 which provides the simulated shaking motion of hand 30. Concealed within the hand 30 is actuator cable 90, similar to a bicycle brake cable, which controls motion of the index finger of hand 30 in the direction of the double-headed arrow shown, all of which simulates "opening" of the hand 30 upon passage of the dice 18 through the chute 66 and discharge out of the hand/fingers and into the pit, all actuated by a signal from the pull of the handle 20 of the machine 10. The cable 90 within its housing 86 is carried through pivot bearings 88 to simulate realistic finger motion.

Figure 11:
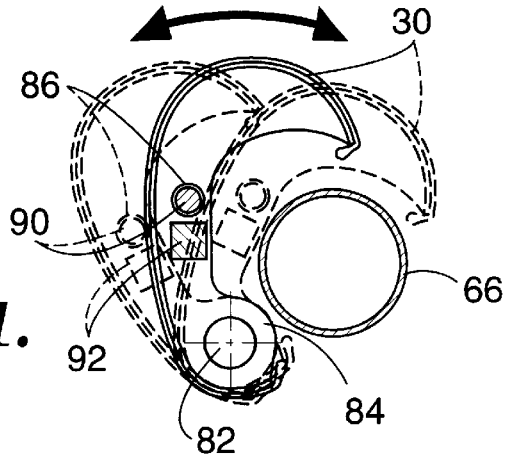
FIG. 11 is a cross-section, taken along line 11—11 of FIG. 10, showing the relative rotational positions of the hand prior to throw of the dice.

FIG. 11, taken substantially along line 11—11 of FIG. 10, depicts the sequential motion of the hand bracket 84, indicated by the double-headed arrow during the simulated shaking, the movement being about drive shaft 82, and indicating the flexibility of cable 90 and its housing sheath 86.

Figure 12:
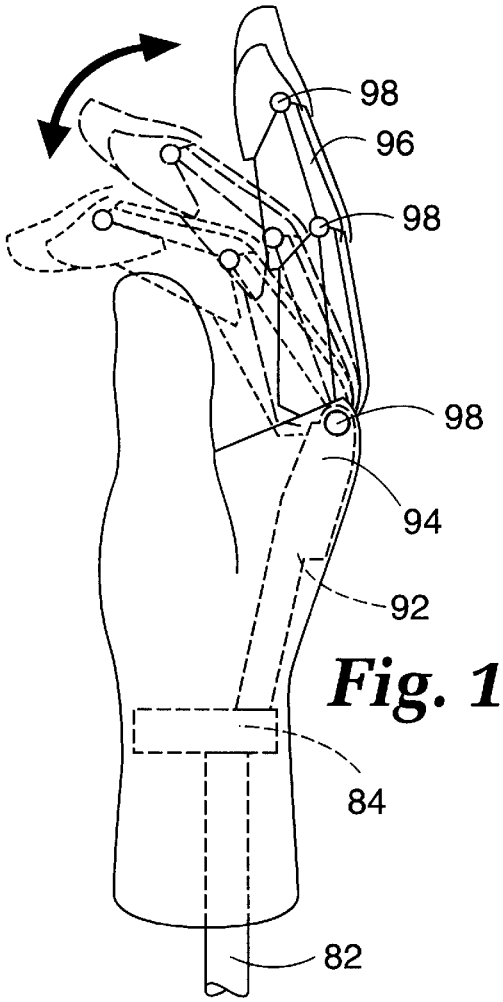
FIG. 12 depicts schematically the movement of the fingers of the mechanical hand upon the "shooting" of the dice.

FIG. 12 shows the sequential motion of the index finger 96 of the hand as it simulates opening upon passage through of the dice. The internal hand structure 94, connected to and manipulated by bracket 84 and shaft 82, mounts the finger 96 and simulated joints 98.

Figure 13:
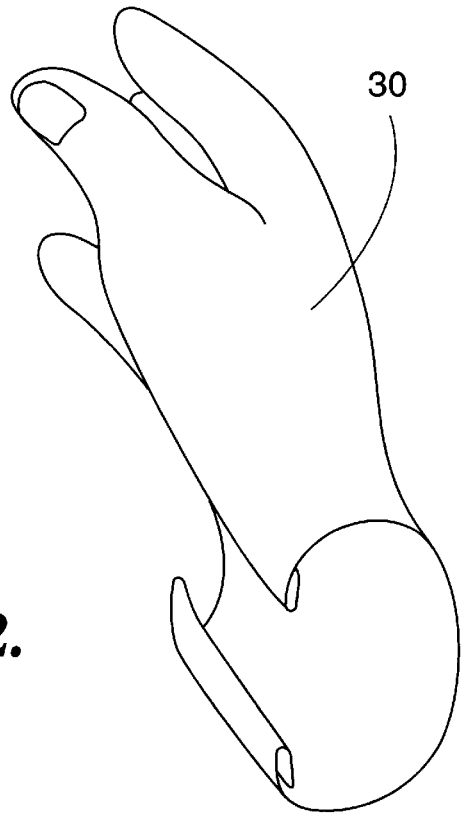
FIG. 13 shows a skin-like covering for the hand, having flesh tone and the outward appearance of a human hand.

FIG. 13 shows the covering of the hand 30 which covers the hand mechanism and is designed to appear as a human hand. Preferably it is of a flesh tone plastic material.

Figure 14:
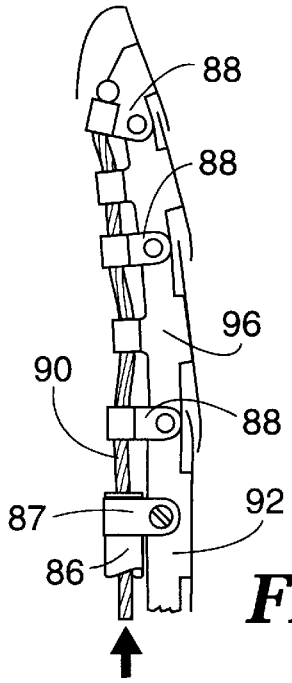
FIG. 14 shows the cabling of one embodiment to enable the fingers of the hand to open and close in realistic appearance.
Figure 15:
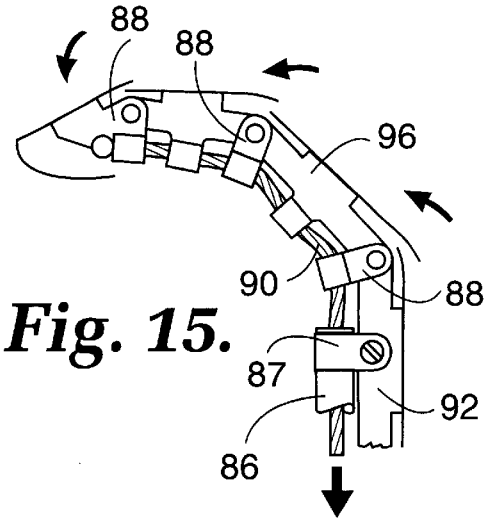
FIG. 15 shows, in mechanical detail, the bending of the index finger of the hand upon pull of its actuating cable.

FIG. 14 shows the simulated index finger 96 in the "open" mode, which configuration is controlled, by electronic signal to the cable drive mechanism (not shown), by the cable 90 passing through pivot bearings 88, the force direction to open the finger being indicated by the arrow. When this force is reversed, upon a signal indicating the end of a given throw, this force is reversed as indicated by the arrow shown in FIG. 15, and the finger 96 is bent, the overall effect being the simulation of the hand "closing".

Figure 16:
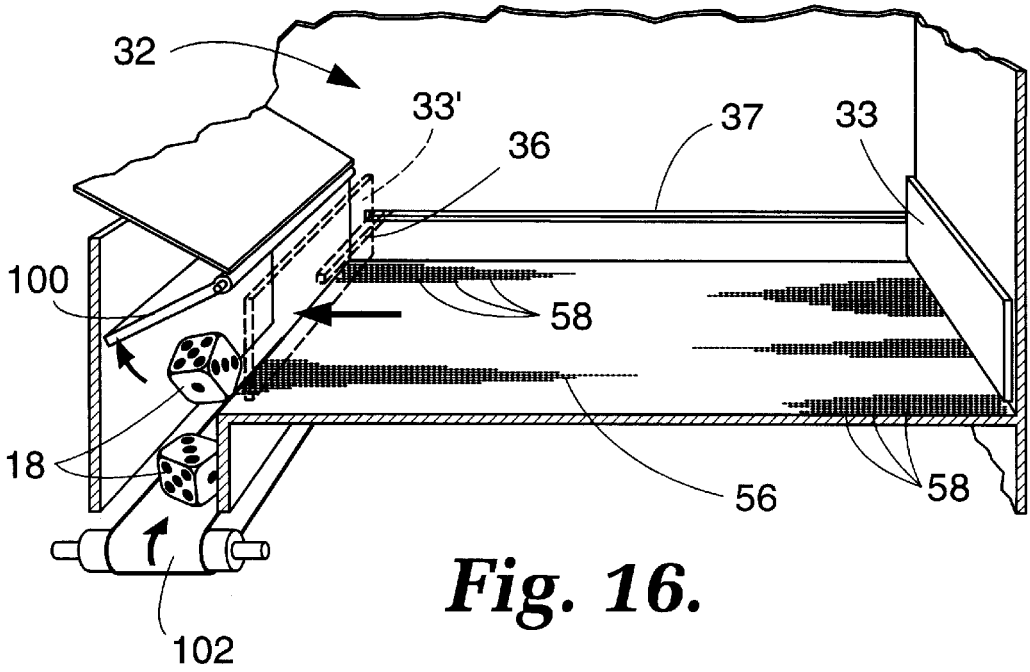
FIG. 16 shows one embodiment of apparatus for clearing the pit of the dice in preparation for the next throw.

FIG. 16 depicts, in schematic perspective, the floor of the pit 32 having printed circuit sensor floor 56 and over which the sweeping gate 33 passes, as indicated by the arrow, to clear the dice 18 after each throw. In one embodiment, as shown, the dice are cleared through a hinged trap door 100 and deposited onto a conveyor belt 102 for conveyance back to chute 62, shown in FIG. 7, and redeposited into chamber 16.

To initiate play, a player deposits a wager in the form of a coin or coins into slot 22 and pulls handle 20. The sequence of events proceeds as described above. All bets are placed against the "house", as in normal casino play. The optional bet buttons 24 and 26 are, for example, for placing additional bets after the "come out" roll, this being actuated by pull of the handle to start play. Push button 25 may be used to play a pass line bet by pushing it (i.e. betting that the dice will total 7 or 11) and, by not pushing, that the "don't pass" bet is chosen. Push buttons may be included for every affirmative action (bet) desired, or buttons may be employed which result in one option ("pass") if pushed and the other available option (i.e. "don't pass") if not pushed. As in most casinos, to adjust the odds to favor the house, each machine may be pre-programmed such that, on come bets (betting "right"), after the point is established, the player wins if 7 or 11 is rolled and loses if 2, 3, or 12 is rolled (crap out). But on a "don't come" bet (betting "wrong"), the player wins by shooting a 2 or 3 on his next roll, or gets a point and fails to make it, in which event the machine (house) pays. But if the player's next roll is 6—6 (or 1—1 in some places), the player does not win, a tie is declared, and the wager is called off.

Other bets proceed accordingly as described above, and variations on play and betting can be built into devices according to the invention by design. A not unimportant feature of this invention results from inherent non-bias. The mechanical "hand", for example, has no skill as would be found in a croupier. The dice should have no particular bias, and, in fact, multiple sets of dice could be mixed and matched and randomly selected from a holding chamber positioned between the pit floor 32 and the holding chamber 16. Each machine could be built and tested to ensure that each has an inherent bias of statistically near-zero, and backed by test data to ensure to each player that his machine is "honest". While most gambling houses (casinos) do not have to cheat to win, their odds advantage being sufficient to guarantee profitability over time, it is well known that every craps dealer is selected for his skill in handling dice. The invention obviates any and all of such biases, to the ultimate benefit of avid players of this time-tested game.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Apparatus for play of the dice game of craps by a player, said apparatus contained in a single free-standing housing and comprising:

a pair of dice or simulation thereof, means for throwing or "shooting" said dice into a pit area or simulation thereof, means for sequentially placing a desired wager upon an outcome of an initial throw and selected subsequent throws of said dice, means for receiving wagers upon the initial and selected subsequent throws of said dice, wherein said wagers on the initial throw may be either "pass line" or "don't pass" wagers, and said wagers on subsequent throws may be either "right" or "wrong" wagers, means for initiating play, thereby to initially actuate said means for throwing said dice, means for determining the total shown on said dice after each throw, means for throwing said dice subsequent to said initial actuating throw, means for tallying the cumulative winning or positive outcomes of each initial and subsequent throws and wagers according to a predetermined schedule, and means for displaying and paying out to the player the total winnings, if any, accrued from said throws of the dice, wherein the means for throwing said dice includes a simulated human hand from which said dice are ejected into said pit area by mechanical means.

2. Apparatus of claim 1, wherein the means for tallying the cumulative winning outcomes of each initial and subsequent throws and wagers include means for stopping all play of said apparatus at the occurrence of the first to occur of the following events:

on a "pass line" wager:

(a) the total shown on the two dice adds up to 7 or 11 on the initial cast;

(b) the total shown on the two dice adds up to 2, 3 or 12 on the initial cast; and on a "don't pass" wager:

(c) the total shown on the two dice adds up to 2 or 3 on the initial cast;

(d) the total shown on the two dice adds up to 7 or 11 on the initial cast; or (e) the total shown on the initial cast adds up to any one of 4, 5, 6, 8, 9 or 10 and the total on a subsequent cast:

(i) is repeated, or (ii) adds up to 7.

3. Apparatus of claim 1, wherein the means for tallying the cumulative winning outcomes of each initial and subsequent throws and wagers include means for stopping all play of said apparatus at the occurrence of the first to occur of the following events:

on a "right" wager:

(a) the total shown on the two dice adds up to 7 or 11 on the next cast;

(b) the total shown on the two dice adds up to 2, 3 or 12 on the next cast; and on a "wrong" wager:

(c) the total shown on the two dice adds up to 2 or 3 on the next cast;

(d) the total shown on the two dice adds up to 7 or 11 on the next cast; or (e) the total shown on the next cast adds up to any one of 4, 5, 6, 8, 9 or 10 and the total on a subsequent cast:

(i) is repeated, or (ii) adds up to 7.

4. The apparatus of claim 1 wherein said means for initiating play is a conventional slot machine lever or handle.

5. The apparatus of claim 1 wherein said means for initiating play is a push button.

6. The apparatus of claim 1 wherein each die of said dice pair has electroconductive spots thereon and the floor of said pit area has electronic detecting sensors therein whereby said sensors detect, after each throw of said dice and Upon said dice coming to rest upon said floor, the total number of spots showing on the top faces of said dice.

7. The apparatus of claim 1 including means for placing a field wager, that is, that the next roll is a 2, 3, 4, 9, 10, 11 or 12, and wherein a total of 2 or 12 pays double.

8. The apparatus of claim 1 including means for placing hardway wagers, that is by rolling double 2's, 3's, 4's or 5's.

9. The apparatus of claim 1 including means for placing one roll bets, that is by rolling a particular number on the next roll of the dice.

* * * * *